United States Patent [19]

Ozawa

[11] Patent Number: 5,029,211

[45] Date of Patent: Jul. 2, 1991

[54] SPEECH ANALYSIS AND SYNTHESIS SYSTEM

[75] Inventor: Kazunori Ozawa, Tokyo, Japan

[73] Assignee: NEC Corporation, Tokyo, Japan

[21] Appl. No.: 358,104

[22] Filed: May 30, 1989

[30] Foreign Application Priority Data

May 30, 1988 [JP] Japan ..... 63-133478
Jun. 2, 1988 [JP] Japan ..... 63-136969

[51] Int. Cl.[5] ..... G10L 5/00
[52] U.S. Cl. ..... 381/36; 381/47
[58] Field of Search ..... 381/36–39, 381/47

[56] References Cited

U.S. PATENT DOCUMENTS 4,520,499 5/1985 Montlick ..... 381/53
4,776,014 10/1988 Zinser ..... 381/50

*Primary Examiner*—Emanuel S. Kemeny
*Attorney, Agent, or Firm*—Sughrue, Mion, Zinn, Macpeak & Seas

[57] ABSTRACT

A speech analysis and synthesis system operates to determine a sound source signal for the entire interval of each speech unit which is to be used for speech synthesis, according to a spectrum parameter obtained from each speech unit based on cepstrum. The sound source signal and the spectrum parameter are stored for each speech unit. Speech is synthesized according to the spectrum parameter while controlling prosody of the sound source signal. The spectrum of the synthesized speech is compensated through filtering based on cepstrum.

3 Claims, 6 Drawing Sheets

SPEECH ANALYSIS AND SYNTHESIS SYSTEM

BACKGROUND OF THE INVENTION

The present invention relates to speech analysis and synthesis system and apparatuses thereof in which spectrum parameter analyzed based on cepstrum and sound source signal obtained according thereto are analyzed for each of a plurality of speech units (for example, several hundred numbers of CV and VC etc.) used for synthesis, the sound source signal is controlled with respect to its prosody (pitch, amplitude and time duration etc.), and a synthesizing filter is driven with the sound source signal to synthesize speech.

There is known system of synthesizing arbitrary words in which linear predictive coefficient according to linear predictive analysis etc. is used as spectrum parameter for speech unit, the spectrum parameter is applied to speech unit to effect analysis to obtain predictive residual signal so that a part thereof is used as sound source signal, and a synthesizing filter constituted according to the linear predictive coefficient is driven by this sound source signal to thereby synthesize speech. Such method is, for example, disclosed in detail in the paper authored by Sato and entitled "Speech Synthesis based on CVC and Sound Source Element (SYMPLE)", Transaction of the Committee on Speech Research, The Acoustic Society of Japan, S83-69, 1984 (hereinafter, referred to as "reference 1"). According to the method of the reference 1, LSP coefficient is used as the linear predictive coefficient, predictive residual signal obtained through linear predictive analysis of original speech unit is used as sound source signal in un-voiced period, and predictive residual signal sliced from a representative one pitch period interval of vowel interval is used as sound source signal in a voiced period to drive the synthesizing filter to thereby synthesize speech. This method has improved speech quality as compared to another method in which a train of impulses is used in the voiced period and noise signal is used in the un-voiced signal.

A plurality of speech units are concatenated to synthesize speech in the speech synthesis, particularly in arbitrary word synthesis. In order to intonate the synthesized speech as natural speech of human speaker, it is necessary to change pitch period of speech signal or sound source signal according to prosodic information or prosodic rule. However, in the method of reference 1, when changing the pitch period of residual signal which is sound source in the voiced period, since the pitch period of original speech unit used in the analysis of coefficient of the synthesizing filter is different from that of speech to be synthesized, mismatching is generated between the changed pitch of residual signal and the spectrum envelope of synthesizing filter. Consequently, the spectrum of synthesized speech is considerably distorted and causes serious drawbacks such as the synthesized speech is greatly distorted, noise is superimposed, and the clearity is greatly reduced. Further, these drawbacks cause a first problem that these drawbacks are particularly noticeable when changing greatly pitch period in case of female speaker who has short pitch period.

Further, conventionally as in the case of reference 1, LPC analysis has been frequently used in the analysis of spectrum parameter representative of spectrum envelope of speech signal. However, in principle, the LPC analysis method has a drawback that the predicted spectrum envelope is easily affected by pitch structure of speech signal to be analyzed. This drawback is particularly remarkable to vowels ("i", "u" and "o" etc.) and nasal consonants in which the first Formant frequency and pitch frequency are close to each other as in the case of female speaker who has high pitch frequency. In the LPC analysis, prediction of Formant is affected by the pitch frequency to thereby cause shift of the Formant frequency and underestimation of band width. Accordingly, there is a second problem that great degradation in speech quality is generated when changing pitch to effect synthesis particularly in case of female speaker.

Moreover, in the foregoing method of reference 1, since the predictive residual signal of the representative one pitch interval of the same vowel interval is repeatedly used in general for vowel intervals, change with the passage of time in spectrum and phase of the residual signal cannot be fully represented for vowel intervals. Consequently, there has been a third problem that the speech quality is degraded in the vowel intervals.

With regard to the first problem, there is known a method to somewhat solve the problem in which peak Formant in lower range of the spectrum envelope is shifted to coincide with a position of the pitch frequency when effecting synthesis. For example, such method is disclosed in a paper authored by Sagisaka et al. and entitled "Synthesizing Method of Spectrum Envelope in Taking Account of Pitch Structure", The Acoustic Society of Japan, lecture Gazette pages 501–502, October 1979 (hereinafter, referred to as "reference 2"). However, in the foregoing method of reference 2, since the Formant peak position is shifted to that of the changed pitch frequency, this is not the fundamental modification, thereby causing another problem that the clearity and speech quality are degraded due to the shift of Formant position.

With regard to the second problem, in order to reduce the affect of pitch structure, there have been proposed various analysis methods such as Cepstrum method, LPC Cepstrum analysis method which is an intermediate analysis method between the foregoing LPC analysis and the Cepstrum method and the modified Cepstrum method which is a modification of the Cepstrum method. Further, there has been proposed a method to directly constitute a synthesizing filter by using these Cepstrum coefficients. The Cepstrum method is disclosed, for example, in a paper authored by Oppenheim et al. and entitled "Homomorphic analysis of speech", IEEE Trans. Audio & Electroacoustics, AU-16, p. 221, 1968 (hereinafter, referred to as "reference 3"). With regard to the LPC Cepstrum method, there is known a method to effect conversion from the linear predictive coefficient obtained by the LPC analysis into the Cepstrum. Such method is disclosed in, for example, a paper authored by Atal et al. and entitled "Effectiveness of Linear Prediction Characteristics of the Speech Wave for Automatic Speaker Identification and Verification", J. Acoustical Soc. America, pp. 1304–1312, 1974 (hereinafter, referred to as reference 4). Further, the modified Cepstrum method is disclosed in, for example, a paper authored by Imai et al. and entitled "Extraction of Spectrum Envelope According to Modified Cepstrum Method", Journal of Electro Communication Society, J62-A, pp. 217–223, 1979 (hereinafter, referred to as "reference 5"). The constructing method of a synthesizing filter using directly Cepstrum coefficient is disclosed in, for example, a paper authored by Imai et al. and entitled "Direct Approximation of Logarithmic Transmission Characteristic in Digital Filter", Journal of Electro Communication Society, J59-A, pp. 157–164, 1976 (hereinafter, referred to as "reference 6"). Therefore, detailed explanation may be omitted. However, though the Cepstrum analysis method and the modified Cepstrum analysis method can solve the forementioned problem of the LPC analysis, the structure of synthesizing filter using directly these coefficients is considerably complicated and requires a great amount of calculation and causes delay, thereby causing another problem that the construction of device is not easy.

SUMMARY OF THE INVENTION

In the speech analysis and synthesis system of the type for analyzing speech units to obtain spectrum parameter and sound source signal to concatenate them to thereby synthesize speech, an object of the present invention is to, therefore, provide the new speech analysis and synthesis system and apparatuses thereof in which the problems of prior art can be solved, natural good speech quality can be obtained for both of the vowel and consonant intervals when driving a synthesizing filter by changing pitch period of sound source signal to synthesize speech, and the synthesizing filter can be easily constructed.

According to the present invention, the speech analysis and synthesis system is characterized in that sound source signal is obtained for the entire interval of speech unit by using spectrum parameter obtained from speech unit signal to be used for the speech synthesis based on Cepstrum, the sound source signal and the spectrum parameter are stored for each of the speech units, the speech is synthesized by using the spectrum parameter while controlling prosodic information of the sound source signal, and a filter is provided to compensate the spectrum of synthesized speech based on the Cepstrum:

According to the present invention, the speech analysis apparatus is characterized by a spectrum parameter calculation circuit for carrying out analysis based on Cepstrum for each time duration predetermined from speech unit signal to be provided for speech synthesis or for each time duration corresponding to pitch parameter extracted from the speech unit so as to calculate spectrum parameter and to store it, and a sound source signal calculating circuit for carrying out inverse filtering according to linear predictive coefficient based on the spectrum parameter for each time interval corresponding to the pitch parameter or for each predetermined time interval.

According to the present invention, the speech synthesizing apparatus is characterized by a sound source signal storing circuit for storing sound source signal for each speech unit, a spectrum parameter storing circuit for storing spectrum parameter determined according to Cepstrum for each of the speech units, a prosody controlling circuit for controlling prosody of the sound source signal, a synthesizing circuit for synthesizing speech by using prosody-controlled sound source signal and the spectrum parameter, and a filtering circuit for compensating spectrum of the synthesized speech by using the spectrum parameter and the other spectrum parameter obtained from the synthesized speech based on Cepstrum.

According to the present invention, the spectrum analysis method of speech signal is such that the spectrum envelope obtained by using the Cepstrum method which is not easily affected by the pitch structure, spectrum envelope obtained by LPC Cepstrum method or modified Cepstrum method is approximated by LPC coefficient as described in the references 2–4. By such method, since both of the analyzing and synthesizing filters can be comprised of a LPC filter, the structure of filter can be simplified. The speech unit is analyzed by using the LPC coefficient obtained based on the Cepstrum or modified Cepstrum so as to obtain predictive residual signal which constitutes the sound source signal. Further, the unit speech has sound source signal for entire intervals without regard to the voiced speech or unvoiced speech, and the synthesizing filter is comprised of LPC synthesizing filter having simple structure. Moreover, in order to compensate spectrum distortion generated when synthesizing speech with changing pitch of the sound source signal, the compensating filter can be comprised of LPC synthesizing filter in which the spectrum distortion is compensated by approximating according to the LPC coefficient the spectrum envelope obtained based on the Cepstrum, LPC Cepstrum or modified Cepstrum as similar to the aforementioned analysis method.

DESCRIPTION OF THE PREFERRED EMBODIMENTS

Figure 1A:
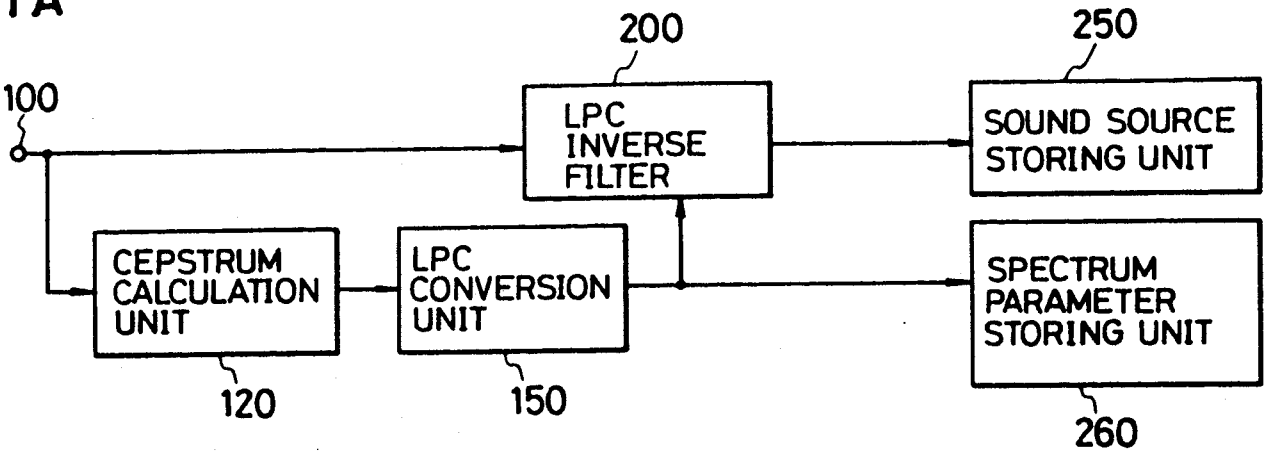
FIG. 1A is a schematic circuit block diagram showing one embodiment of speech analysis apparatus according to the present invention.
Figure 1B:
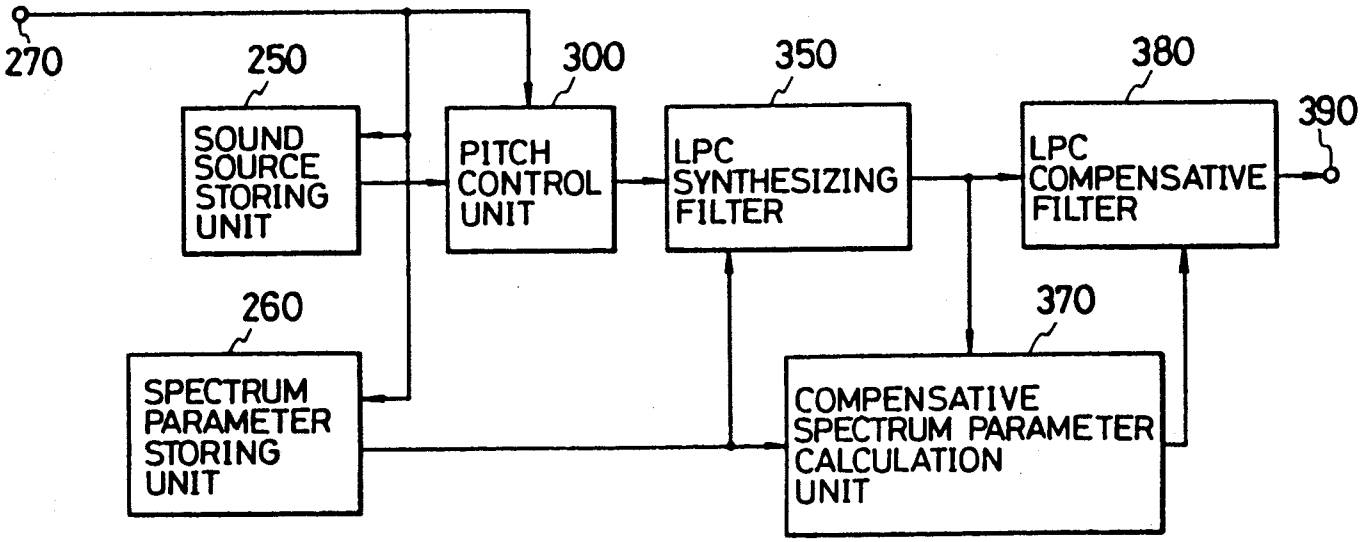
FIG. 1B is a schematic circuit block diagram showing one embodiment of speech synthesis apparatus according to the present invention for use in 10 combination with the speech analysis apparatus of FIG. 1A to constitute speech analysis and synthesis system.

The speech analysis and synthesis system is comprised of a combination of speech analysis apparatus and speech synthesis apparatus. FIG. 1A shows one embodiment of the analysis apparatus and FIG. 1B shows one embodiment of the synthesis apparatus.

Referring to FIG. 1A, when speech unit signal (for example, CV and VC etc.) for use in the synthesis is input into a terminal 100, a Cepstrum calculating unit 120 calculates Cepstrum for each of a plurality of predetermined time durations or for each of a plurality of separately calculated pitch periods in vowel interval. This calculation can be carried out according to a method of using FFT, a method of conversion from linear predictive coefficient obtained by LPC analysis, modified Cepstrum analysis method and so on. Since the detailed methods are disclosed in the before-mentioned references 3–5, the explanation thereof is omitted here. In this embodiment, the modified Cepstrum analysis method is adopted.

A Cepstrum conversion unit 150 receives Cepstrum c(i) (i=o to P; where P is degree) obtained in the Cepstrum calculation unit 120 to calculate linear predictive coefficient a(i). More specifically, the Cepstrum is once processed by FFT (for example at 256 points) to obtain smoothed logarithmic spectrum, and then this spectrum is converted into smoothed power spectrum through exponential conversion. Then, this smoothed power spectrum is processed by inverse FFT (for example, at 256 points) to obtain autocorrelation function. LPC coefficient is obtained from the autocorrelation function. With regard to the LPC coefficient, there is known various kinds such as linear predictive coefficient, PARCOR and LSP. The linear predictive coefficient is adopted in this embodiment. The linear predictive coefficient a(i) (i=1 to M) can be determined from the autocorrelation function recurrently by known method such as Durbine method. The obtained linear predictive coefficient is stored in a spectrum parameter storing unit 260 for each of the speech units.

An LPC inverse filtering unit 200 carries out inverse filtering using the linear predictive coefficient to determine predictive residual signal as sound source signal for entire interval of the speech unit signal, and the sound source signal is stored in a sound source signal storing unit 250 for each speech unit. Further, a starting position of each pitch period is also stored for vowel interval of the predictive residual signal.

Referring to FIG. 1B, on the other hand, in the synthesis apparatus, a sound source signal storing unit 250 selects a needed speech unit according to control information input into a terminal 270 so as to output predictive residual signal corresponding to the selected speech unit.

A pitch controlling unit 300 carries out, according to information effective to change pitch and contained in the controlling information, expansion and contraction of the residual signal pitch for each pitch interval based on the pitch period starting position in the vowel interval. More specifically, as described in the reference 1, when expanding the pitch period, zero values are inserted after the pitch interval, and when contracting the pitch period, sample is cut out from the rear portion of pitch interval. Further, the time duration of vowel interval is adjusted for each pitch unit using a time duration designated by the before-mentioned controlling information.

A spectrum parameter storing unit 260 selects a speech unit according to the controlling information so as to output LPC parameter $a_i$ corresponding to the selected speech unit.

A LPC synthesizing filter 350 has the following transfer property:

$$S(z) = 1/\left(1 - \sum_i a_i z^{-i}\right) \tag{1}$$

and outputs synthesized speech x(n) using a pitch-changed predictive residual signal and a LPC parameter.

A spectrum parameter compensative calculation unit 370 calculates, based on Cepstrum, compensative spectrum parameter $b_i$, which is effective to compensate spectrum distortion of the synthesized speech caused when changing pitch using LPC parameter $a_i$ and the synthesized speech x(n). While the Cepstrum may be of various kinds as described before, this embodiment employs LPC Cepstrum easily converted from the LPC coefficient. More specifically, the method includes the steps of first carrying out the conversion into LPC Cepstrum c'(i) using LPC parameter $a_i$ according to the method of reference 5, and then calculating the following power spectrum $H^2(Z)$:

$$H^2(Z) = \exp\left(\sum_i c'(i) Z^{-i}\right) \tag{2}$$

Next, LPC analysis is carried out for each interval duration predetermined with respect to the vowel interval of synthesized speech x(n) or in synchronization with pitch so as to calculate the spectrum parameter $a_i'$. Then, the spectrum parameter $a_i'$ is converted into LPC Cepstrum C''(i) to calculate the following power spectrum $F^2(Z)$:

$$F^2(z) = \exp\left(\sum_i c''(i) z^{-i}\right) \tag{3}$$

Then, the ratio of the relation (2) to the relation (3) is calculated as follows:

$$G^2(z) = H^2(z)/F^2(z) \tag{4}$$

Further, the relation (4) is processed by the inverse Fourier transformation to calculate an autocorrelation function R(m), and the compensative spectrum parameter $b_i$ is calculated from R(m) according to LPC analysis. In addition, the relations (2) and (3) can be calculated by using FFT. Further, though the calculation of relation (3) is carried out based on the LPC Cepstrum in this embodiment, the calculation can be carried out based on the Cepstrum or modified Cepstrum.

An LPC compensative filter 380 has the following transfer function Q(z):

$$Q(z) = 1/\left(1 - \sum_i b_i z^{-i}\right) \tag{5}$$

and receives the synthesized speech x(n) so as to output at its terminal 390 compensated synthesized speech x'(n) in which the spectrum distortion thereof is compensated by using the compensative spectrum parameter $b_i$.

Figure 2A:
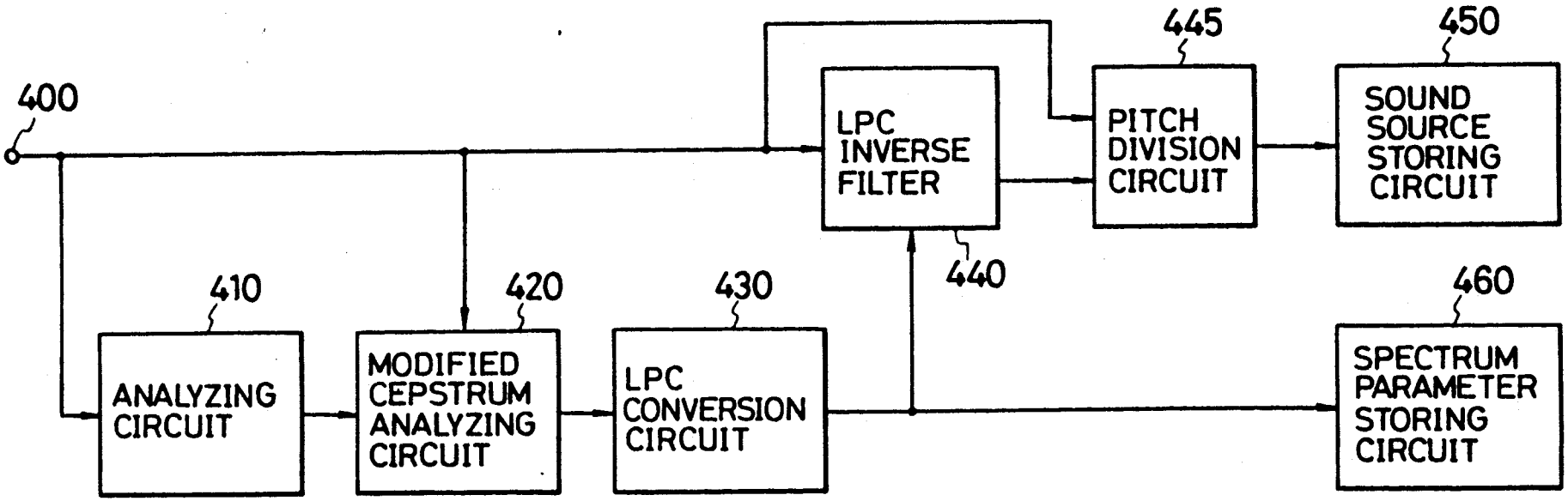
FIG. 2A is a detailed circuit block diagram of the FIG. 1A embodiment.

Referring to FIG. 2A which shows detailed circuit structure of the FIG. 1A analysis apparatus, speech unit signal is input into an input terminal 400, and an analyzing circuit 410 carries out the LPC analysis once for each predetermined time duration or, in case of the vowel interval, for each duration identical to the pitch period, and thereafter effects the conversion into the LPC Cepstrum. A modified Cepstrum calculation circuit 420 operates to calculate the modified Cepstrum having a predetermined degree, which is hardly affected by the pitch of speech, by setting the LPC Cepstrum as the initial value and using modified Cepstrum method as described before with respect to the FIG. 1A embodiment. Although the LPC Cepstrum is used as the initial value in this embodiment, Cepstrum obtained by FFT may be used as the initial value.

An LPC conversion circuit 430 operates to approximate the spectrum envelope represented by the modified Cepstrum by the LPC coefficient. The more specific method is described before with respect to the explanation of FIG. 1A embodiment. The linear predictive coefficient is used for the LPC coefficient. The linear predictive coefficient having the predetermined degree is stored in a spectrum parameter storing circuit 460 with respect to the entire interval of the speech unit.

An LPC inverse filter 440, receives the linear predictive coefficient of the predetermined degree, and carries out the inverse filtering of the speech unit signal to thereby obtain the predictive residual signal for the entire interval of the speech unit.

A pitch division circuit 445 operates in the vowel interval of speech unit to determine a pitch-division position for the predictive residual signal. The predictive residual signal is stored in a sound signal together with the pitch-division position. The pitch-division position can be calculated, preferably by a method such as disclosed in Japanese patent application No. 210690/1987 (hereinafter, referred to as "reference 6").

Figure 2B:
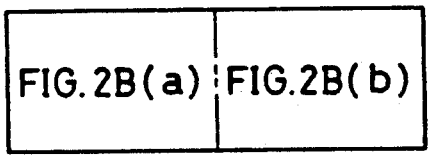
FIG. 2B is a detailed circuit block diagram of the FIG. 1B embodiment.
Figure 2B:
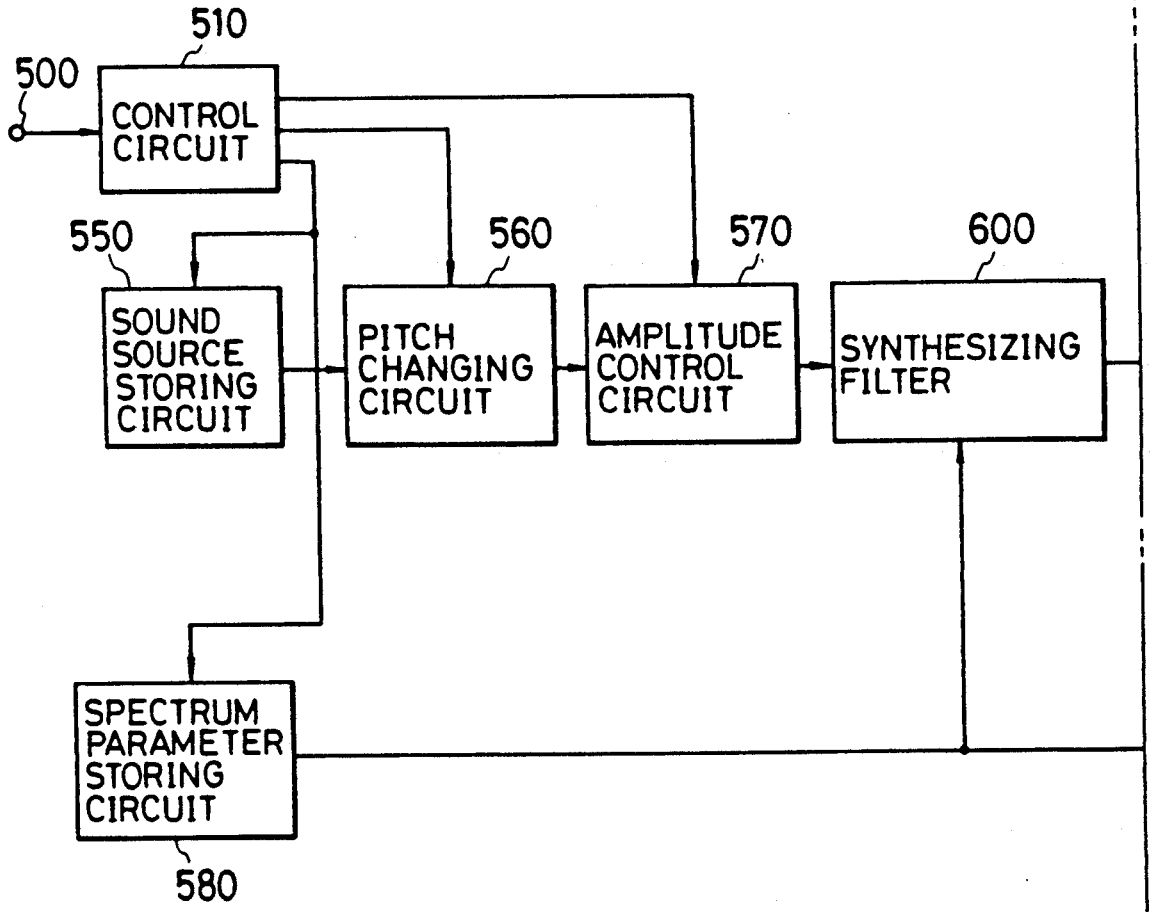
Figure 2B:
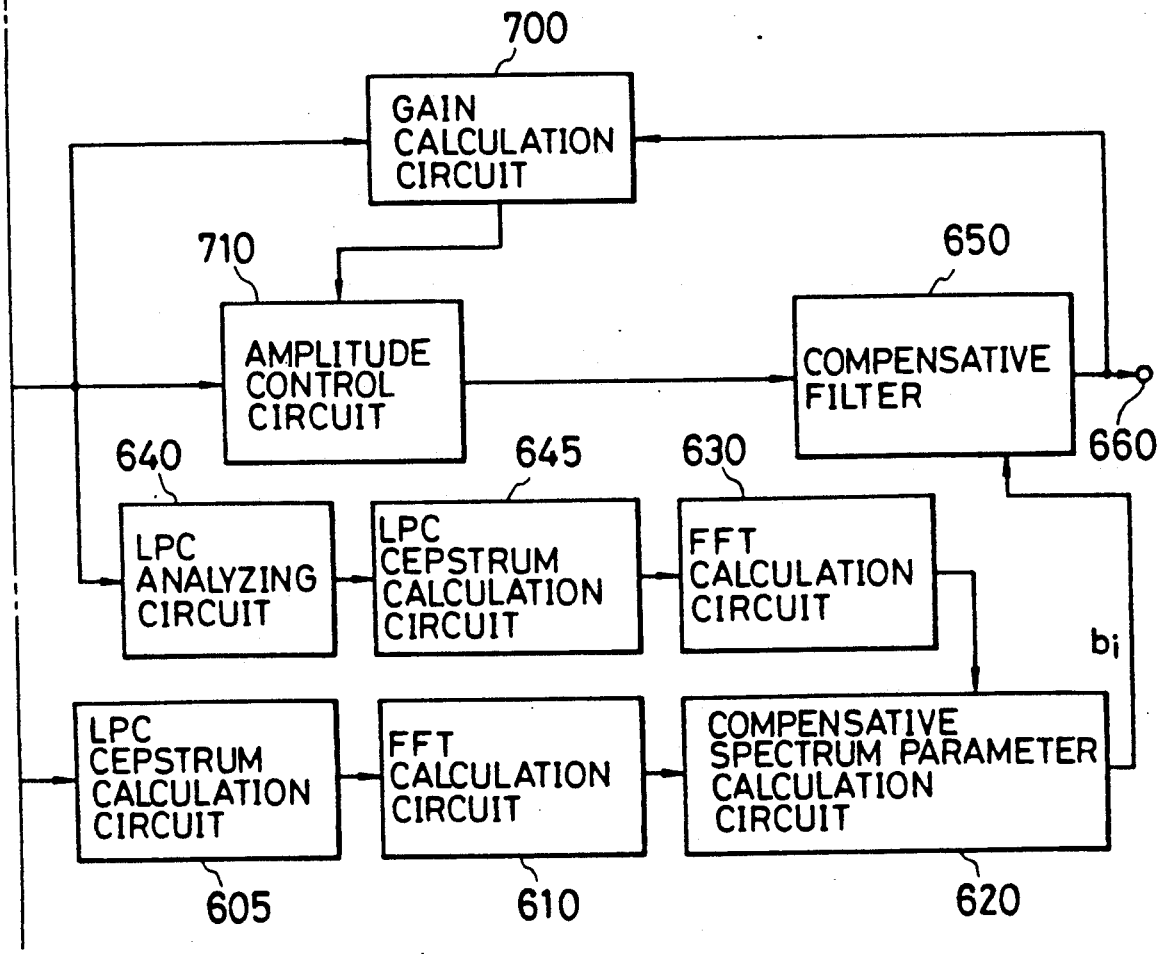

Referring to FIG. 2B which shows detailed circuit structure of the FIG. 1B synthesis apparatus. A controlling circuit 510 is input through a terminal 500 with prosodic information (pitch, time duration and amplitude) and concatenation information of speech units, and outputs them to a sound source storing circuit 550, a spectrum parameter storing circuit 580, a pitch changing circuit 560, and an amplitude controlling circuit 570.

The sound source storing circuit 550 receives the concatenation information of speech units and outputs predictive residual signal corresponding to the respective speech unit. The pitch changing circuit 560 receives the pitch control information and carries out change in pitch of the predictive residual signal using the pitch division position predetermined in the vowel interval. The particular way of carrying out the change of pitch can utilize the method described with respect to the explanation of the FIG. 1B apparatus and other known methods.

Next, the amplitude control circuit 570 receives the amplitude control information and controls according thereto the amplitude of predictive residual signal to output e(n). A spectrum parameter storing circuit 580 receives the concatenation information of speech units and outputs a series of the spectrum parameters corresponding to the speech units. Though the LPC coefficient $a_i$ is used for the spectrum parameter as explained before with respect to the FIG. 1B apparatus in this embodiment, other known parameters can be used instead thereof. A synthesizing filter 600 has the property indicated by the relation (1), and receives the pitch-changed predictive residual signal to calculate by using the coefficient $a_i$ the synthesized speech x(n) according to the following relation:

$$x(n) = e(n) + \sum_i a_i \cdot x(n-i) \tag{6}$$

Another amplitude control circuit 710 applies gain G to the synthesized speech x(n) to output it. The gain G is inputted from a gain calculation circuit 700. The operation of gain calculation circuit 700 will be explained later.

An LPC Cepstrum calculation circuit 605 converts the LPC coefficient into LPC Cepstrum c'(i).

An FFT calculation circuit 610 receives c'(i) and carries out FFT (Fast Fourier Transformation) at predetermined number of points (for example 256 points) to calculate and output the power spectrum $H^2(z)$ defined by the relation (2). The calculation of FFT is, for example, described in a text book authored by Oppenheim et al. and entitled "Digital Signal Processing" Prentice-Hall, 1975, Section 6 (hereinafter, referred to as "reference 7") and therefore the explanation thereof is omitted here.

An LPC analyzing circuit 640 carries out the LPC analysis in the vowel interval of the synthesized speech x(n) obtained by changing the pitch period so as to calculate the LPC coefficient $a_i'$. At this time, as described in connection with the FIG. 1B apparatus, the LPC analysis can be carried out in synchronization with the pitch or can be carried out for each of the fixed duration frame intervals.

An LPC Cepstrum calculation circuit 645 converts the LPC coefficient into the LPC Cepstrum c''(i).

An FFT calculation circuit 630 receives the coefficient c''(i), and calculates and outputs the power spectrum $F^2(z)$ defined by the relation (3). As described in connection with the FIG. 1B apparatus, the LPC Cepstrum can be employed, or Cepstrum and modified Cepstrum can be employed.

A spectrum parameter compensative calculation circuit 620 calculates $G^2(z)$ according to the relation (4) by using $H^2(z)$ and $F^2(z)$. Further, this circuit carries out the inverse FFT to obtain autocorrelation function R(m) and carries out the LPC analysis to determine the LPC coefficient $b_i$.

A compensative filter 650 receives the output from the amplitude control circuit 710, and calculates with using the coefficient $b_i$ synthesized speech x'(n) compensated for its spectrum distortion according to the following relation:

$$X'(n) = G \cdot x(n) + \sum_i bi \cdot x'(n-i) \tag{7}$$

where G·x(n) indicates input signal of the compensative filter 650.

The gain calculation circuit 700 calculates the gain G effective to adjust the powers of each pitch of x(n) and x'(n) to each other in the pitch changed interval. This means that the gain G of compensative filter 650 is not equal to 1. More specifically, the power of x(n) and x'(n) is calculated for each pitch, respectively, in the pitch-changed interval according to the following relations:

$$P1 = 1/N \cdot \sum_n x^2(n) \tag{8a}$$

$$P2 = 1/N \cdot \sum_n x'^2(n) \tag{8b}$$

where N indicates a number of samples in the pitch-changed interval. Then, the gain G is determined according to the following relation:

$$G = \sqrt{P1/P2} \tag{9}$$

This final synthesized speech signal x'(n) applied with the gain G is outputted through a terminal 660.

The above described embodiment is only one examplified structure of the present invention, and various modifications can be easily made. Though the predictive residual signal obtained by the linear predictive analysis is utilized as the sound source signal over the entire interval of speech unit in the above described embodiment, it may be expedient to use repeatedly predictive residual signal representative of one pitch interval for the voiced interval, particularly for the vowel interval controlling the amplitude and pitch thereof in order to reduce the amount of calculation and capacity of memory.

Further, the sound source signal may be comprised of not only predictive residual signal obtained by the linear predictive analysis but also other suitable signals such as zero-phased signal, phase-equalized signal and multi-pulse sound source.

Moreover, the spectrum parameter may be comprised of other suitable spectrum parameters than that used in the disclosed embodiment, such as Formant, ARMA, PSE, LSP, PARCOR, Melcepstrum, generalized Cepstrum, and mel-generalized Cepstrum.

In addition, though the spectrum parameter storing circuit 260 stores the LPC coefficient as the spectrum parameter in the embodiment, the storing circuit can store Cepstrum or modified Cepstrum. However, in these cases, the synthesis apparatus needs a LPC conversion circuit at the preceding stage of the LPC synthesizing filter.

The spectrum parameter of compensative filter may be also comprised of other suitable parameters than that used in the disclosed embodiment, such as Formant, ARMA, PSE, LSP, PARCOR, Melcepstrum, generalized cepstrum, and mel-generalized cepstrum.

Further, though the compensative filter is comprised of all pole type filter as indicated by the relation (5) in the embodiment, it may be comprised of zero-pole type filter or FIR filter. However, in these cases, the amount of calculation would be considerably increased.

In addition, the amplitude control circuit 710 and the gain calculation circuit 700 could be eliminated in order to reduce the amount of calculation. However, in this case, level of the synthesized speech x'(n) would change more or less.

Further, compensative filter circuit 650, LPC analyzing circuits 640 and 605, LPC Cepstrum calculation circuit 645, FFT calculation circuits 610 and 630 and compensative spectrum parameter calculation circuit 620 can be eliminated to reduce the computation amount.

Further, though the amplitude control circuit 570 controls the power of residual signal in the embodiment, it may be expedient that the amplitude control circuit is constructed in the structure identical to the gain calculation circuit 700 and the amplitude control circuit 710 and operates to control the power of synthesized speech x(n). However, in this case, the control signal input from the control circuit 510 is not of unit power for each pitch of the residual signal, but should be of unit power for each pitch of the synthesized speech.

Further, the amplitude control circuits 570 and 710, and the gain calculation circuit 700 could be eliminated for simplification.

In addition, it would be expedient that the analysis apparatus does not carry out the pitch-division, while the corresponding control information is provided during the synthesis. By such construction, the pitch-division circuit 445 could be eliminated.

Further, though the prosodic information is input through the terminal 500 in the disclosed embodiment, it would be expedient to input accent information and intonation information with respect to the prosodic control and to generate prosodic control information according to predetermined rules.

Moreover, it would be expedient that the calculation of compensative filter is carried out only when the change of pitch is large in the pitch control circuit 560 in order to reduce the calculation amount.

Also, it would be expedient to keep compensative spectrum parameter as code book for each speech unit according to changing degree of pitch or to provisionally keep the change of spectrum parameter itself as code book or table so as to refer to the optimum change of spectrum parameter. By such construction, the calculation of compensative filter could be simplified in the former case, and the calculation of compensative filter could be eliminated in the latter case.

As described above, according to the present invention, since the sound source signal and spectrum parameter are provided for entire interval of the speech unit so as to synthesize speech using these signal and parameter, the present invention can achieve great effect that the synthesized speech has good quality not only in the consonant interval, but also in the vowel interval in which the speech quality would be degradated in the conventional apparatus.

Further, according to the present invention, since the analysis method hardly affected by pitch is applied to the calculation of spectrum parameter and compensation thereof as well as the compensative filter is provided to compensate the spectrum distortion generated when the synthesis is carried out by changing the pitch of sound source signal greatly as compared to the pitch period of sound source signal which is provisionally analyzed and stored, the present invention can achieve the effect that the synthesized speech has substantially no quality degradation. This effect is particularly noticeable for female speaker of short pitch period.

Figure 3:
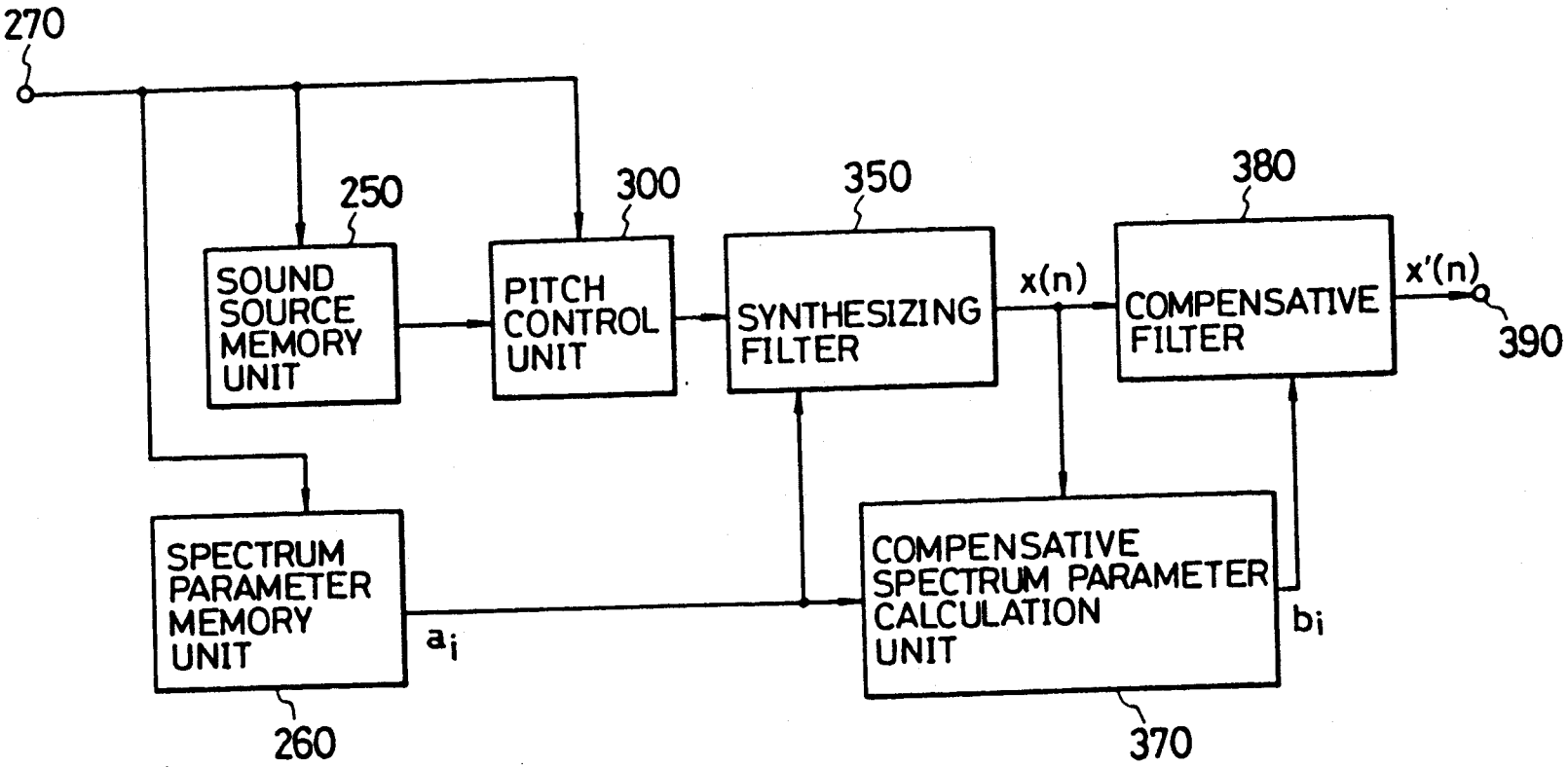
FIG. 3 is a schematic circuit block diagram showing another embodiment of speech synthesis apparatus according to the present invention.

FIG. 3 is a schematic block diagram showing another embodiment of the speech synthesis apparatus according to the present invention. A sound source signal memory unit 250 memorizes a sound source signal for each speech unit, which is obtained by analyzing a speech signal for each of speech units (for example, CV and VC). Also, a spectrum parameter memory unit 260 memorizes spectrum parameter (degree $M_1$) obtained through analysis. The known linear predictive analysis is employed as the analysis method and predictive residual signal obtained by the linear predictive analysis is utilized as the sound source signal in this embodiment. However, other suitable types of spectrum parameters and sound source signals can be employed. Further, a starting position of each pitch is also stored for the vowel interval of predictive residual signal. Various types of spectrum parameters can be adoptable as the linear predictive parameter, and LPC parameter is used in this embodiment. Other known parameters can be used, such as LSP, PARCOR and Formant. The analysis can be carried out for predetermined fixed frame (5 ms or 10 ms), or the pitch-synchronizing analysis can be carried out for vowel interval in synchronization with the pitch period.

Further, the sound source signal 250 operates based on control signal input from a terminal 270 to select needed speech units and to output predictive residual signal corresponding thereto.

A pitch controlling unit 300 operates with using information effective to change pitch contained in the above-mentioned information so as to effect expansion and contraction of the residual signal for each pitch interval, based on the pitch starting position in the vowel interval. More specifically, as described in the reference 1, a zero value is inserted into the rear portion of pitch period when expanding the pitch period, and a sample is cut out from the rear portion of the pitch period when contracting the pitch period. Further, the time duration of vowel interval is regulated at each pitch unit using the time duration designated in the control information.

A spectrum parameter memory unit 260 memorizes LPC parameter provisionally obtained by the linear predictive analysis for each speech unit. Then, according to the above-mentioned control information, the memory 260 is operated to select speech unit and outputs LPC parameter $a_i$ (degree $M_1$) corresponding thereto.

A synthesizing filter 350 has the following transfer characteristic:

$$S(z) = \frac{1}{1 - \sum_{i=1}^{M1} a_i z^{-1}} \tag{10}$$

and outputs synthesized speech x(n) with using the pitch-changed predictive residual signal and LPC parameter.

A spectrum parameter compensative calculation unit 370 calculates compensative spectrum parameter $b_i$ effective to compensate spectrum distortion generated in the synthesized speech when changing the pitch using LPC parameter $a_i$ and the synthesized speech x(n). More specifically, at first the calculation unit 370 calculates with using the LPC parameter $a_i$ the following power spectrum $H^2(z)$:

$$H^2(z) = \frac{1}{\left|1 - \sum_{i=1}^{M1} a_i z^{-1}\right|^2} \tag{11}$$

Next, the LPC analysis is carried out for each predetermined interval duration or in synchronization with the pitch with respect to the vowel interval of synthesized speech x(n) to calculate spectrum parameter $a_i'$ (degree $M_2$) and to thereby calculate using this parameter the following power spectrum $F^2(z)$:

$$F^2(z) = \frac{1}{\left|1 - \sum_{i=1}^{M2} a_i' z^{-1}\right|^2} \tag{12}$$

Next, the ratio of the relation (11) to the relation (12) is calculated as follows:

$$G^2(z) = \frac{H^2(z)}{F^2(z)} \tag{13}$$

Then, the inverse Fourier transform of the relation (13) is carried out to obtain autocorrelation function R(m), and the LPC analysis is carried out to calculate the compensative spectrum parameter $b_i$ (degree $M_3$) from R(m). Meanwhile, the relations (11) and (12) can be calculated by using the Fourier transform.

A compensative filter 380 has the following transfer function Q(z):

$$Q(z) = \frac{1}{1 - \sum_{i=1}^{M3} b_i z^{-1}} \tag{14}$$

and is input with the synthesized speech x(n) and output to a terminal 390 synthesized speech x'(n) which compensates the spectrum distortion thereof with using the compensative spectrum parameter $b_i$.

Figure 4:
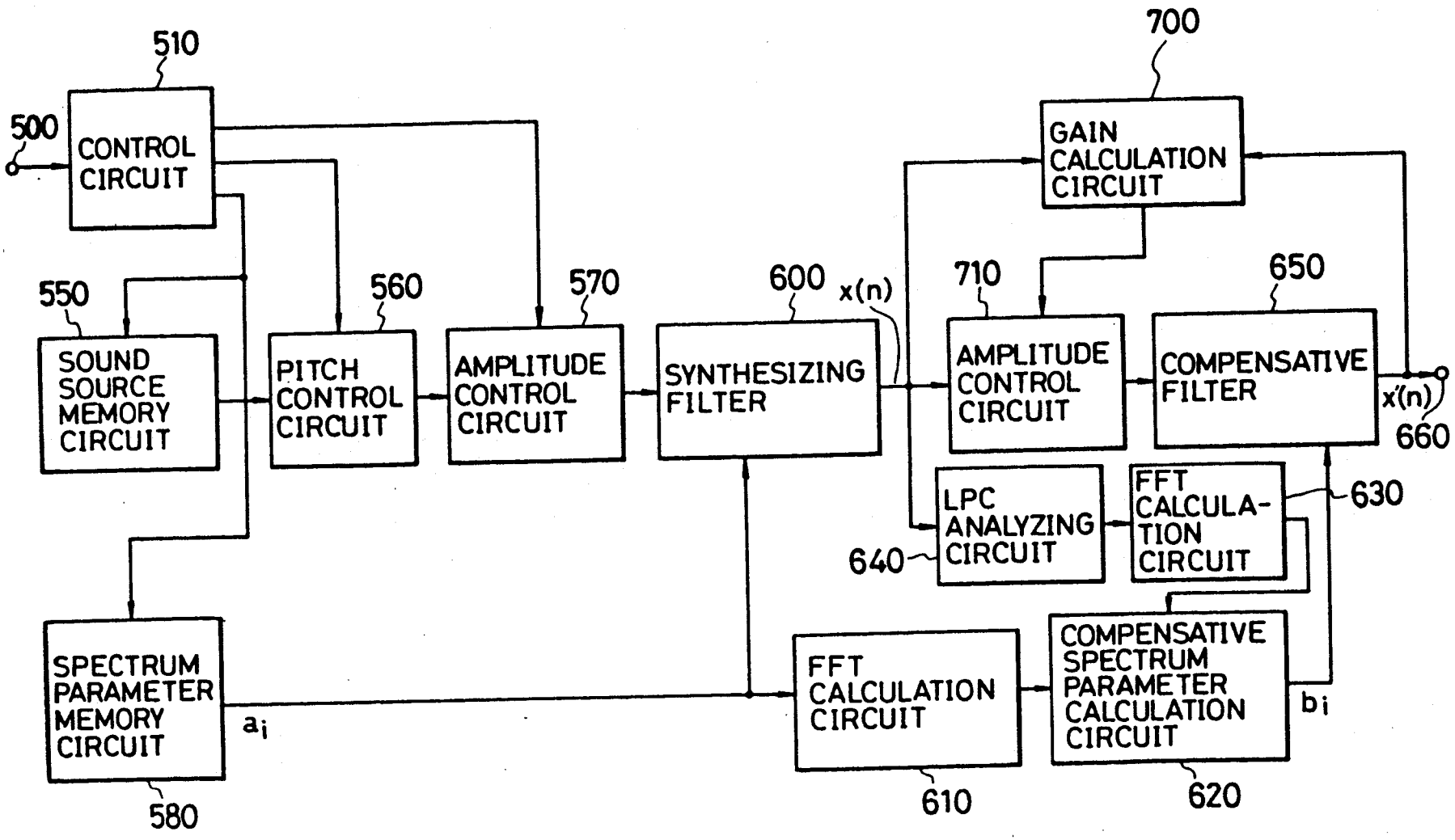
FIG. 4 is a detailed circuit block diagram of the FIG. 3 embodiment.

Referring to FIG. 4 which shows detailed circuit structure of the FIG. 3 embodiment, a control circuit 510 receives through a terminal 500 prosodic control information (pitch, time duration and amplitude) and concatenation information of the speech units, and outputs them to a sound source memory circuit 550, pitch control circuit 560, and amplitude control circuit 570. The sound source memory circuit 550 receives the concateration information of speech unit and outputs the predictive residual signal corresponding to the speech unit. The pitch control circuit 560 receives the pitch control information and effects change of pitch of predictive residual information with using pitch-division position provisionally designated in the vowel interval. The method described in connection with the FIG. 3 embodiment and other known methods can be used for the specific method of changing the pitch.

Next, the amplitude control circuit 570 receives the amplitude control information, and controls according thereto the amplitude of predictive residual signal to thereby output the predictive residual signal e(n). The spectrum parameter memory circuit 580 receives the concatenation information of speech units and outputs a chain of the spectrum parameters corresponding to the speech units. The LPC coefficient $a_i$ is used as the spectrum parameter here as described in the FIG. 3 embodiment, while other known parameters can be employed.

A synthesizing filter circuit 600 has the property of the relation (1), and receives the pitch-changed predictive residual signal to calculate the synthesized speech x(n) using the LPC coefficient $a_i$ according to the following relation:

$$x(n) = e(n) + \sum_{i=1}^{M1} a_i \cdot x(n - i) \tag{15}$$

An amplitude control circuit 710 applies gain G to the synthesized speech x(n) to thereby output the result. The gain G is provided from a gain calculation circuit 700. The operation of gain calculation circuit 700 will be described hereafter.

An FFT calculation circuit 610 receives the LPC coefficient $a_i$, and carries out the FFT (Fast Fourier Transform) for a predetermined number of points (for example, 256 points) to calculate and output the power spectrum $H^2(z)$ defined by the relation (11). The calculation method of FFT is described, for example, in the reference (7), and therefore the explanation thereof is omitted here.

An LPC analysis circuit 640 carries out the LPC analysis in the vowel interval of synthesized speech x(n) obtained by changing the pitch period so as to calculate LPC coefficient $a_i'$. At this time, as described in the FIG. 3 embodiment, LPC analysis can be carried out in synchronization with pitch, or otherwise can be carried out for each fixed frame interval. An FFT calculation circuit 630 receives the coefficient $a_i'$, and calculates and outputs the power spectrum $F^2(z)$ as determined by the relation (12).

A compensative spectrum parameter calculation circuit 620 calculates the ratio $G^2(z)$ according to the relation (13) using the power spectrums $H^2(z)$ and $F^2(z)$. Further, this is processed through inverse FFT to obtain the autocorrelation function R(m), and the LPC analysis is carried out to determine LPC coefficient $b_i$.

A compensative filter 650 receives the output from the amplitude control circuit 710 using the coefficient $b_i$ to calculate the synthesized speech x'(n) compensated of its spectrum distortion according to the following relation:

$$x'(n) = G \cdot x(n) + \sum_{i=1}^{M3} b_i \cdot x'(n-i) \tag{7}$$

wherein G·x(n) indicates the input signal of the compensative filter 650.

The gain calculation circuit 700 operates in the pitch-changed interval to calculate the gain G effective to equalize mean powers per pitch of the synthesized speechs x(n) and x'(n) to each other. This means that the gain of compensative filter 650 is not equal to a value of 1. More specifically, the mean powers per pitch of synthesized speechs x(n) and x'(n) are calculated in the pitch changed interval, respectively, according to the following relations:

$$P1 = 1/N \cdot \sum_{n=1}^{N} x^2(n) \tag{17a}$$

$$P2 = 1/N \cdot \sum_{n=1}^{N} x'^2(n) \tag{17b}$$

where N indicates the number of samples in the pitch interval. Then, the gain G is obtained according to the following relation:

$$G = \sqrt{P1/P2} \tag{18}$$

The final synthesized speech signal x'(n) applied with the gain G is outputted through the terminal 660.

What is claimed is:

1. A speech analysis and synthesis system comprising:

means for determining a sound source signal for an entire interval of a speech unit which is to be used for speech synthesis, according to a spectrum parameter obtained from a signal of said speech unit based on cepstrum;

means for storing said sound source signal and said spectrum parameter for said speech unit;

means for synthesizing speech according to said spectrum parameter while controlling prosodic information on a duration, a pitch and an amplitude of said speech unit concerning said sound source signal; and filter means for compensating spectrum of said synthesized speech, to remove spectral distortion, based on cepstrum from said synthesized speech and cepstrum from said stored spectrum parameter.

2. A speech analysis apparatus used in a speech analysis and synthesis system as claimed in claim 1, wherein said determining means comprises:

a spectrum parameter calculation circuit operative to carry out analysis based on cepstrum for a selected one of a plurality of time durations predetermined from said speech unit signal which is to be used for speech synthesis or for a selected one of a plurality of time durations corresponding to a pitch period of a pitch parameter extracted from said speech unit so as to calculate and store said spectrum parameter; and a sound source signal calculation circuit for carrying out inverse filtering according to a linear predictive coefficient based on said spectrum parameter for said selected one of each of said predetermined time durations or for said selected one of said time durations corresponding to said pitch period of said pitch parameter so as to determine and store said sound source signal of the entire said speech unit.

3. A speech synthesis apparatus used in a speech analysis and synthesis system as claimed in claim 1, wherein said storing means comprises:

a sound source signal storing circuit for storing a sound source signal for each of speech units;

a spectrum parameter storing circuit for storing spectrum parameter determined according to cepstrum for each of said speech units;

wherein said synthesizing means comprises:

a prosody control circuit for controlling prosody on the duration, pitch and amplitude of said speech unit concerning said sound source signal so as to permit changing said duration, said pitch and said amplitude;

a synthesis circuit for synthesizing speech according to said prosody controlled sound source signal and said spectrum parameter;

and wherein said filter means comprises:

a filter circuit for compensating spectrum of said synthesized speech according to said spectrum parameter to remove spectral distortion based on cepstrum from the synthesized speech and cepstrum from said stored spectrum parameter.

* * * * *